US005551492A

United States Patent [19]

Rack et al.

[11] Patent Number: 5,551,492

[45] Date of Patent: Sep. 3, 1996

[54] ROTARY DISC FEEDER

[75] Inventors: Daniel J. Rack, Cincinnati, Ohio; Michael E. Myers, Bellevue, Ky.

[73] Assignee: R.A. Jones & Co. Inc., Crescent Springs, Ky.

[21] Appl. No.: 293,020

[22] Filed: Aug. 19, 1994

[51] Int. Cl.[6] ..... B65B 1/00

[52] U.S. Cl. ..... 141/147; 141/166

[58] Field of Search ..... 141/137, 142, 141/144, 145, 147, 152, 166, 177; 222/305, 307, 370

[56] References Cited

U.S. PATENT DOCUMENTS

| | | | |
|---|---|---|---|
| 584,891 | 6/1897 | Pierce | 141/147 X |
| 897,402 | 9/1908 | Small | 141/145 |
| 1,512,764 | 10/1924 | Holmquist, Sr. | 141/147 X |
| 2,320,581 | 6/1943 | First et al. | 141/142 X |
| 3,217,944 | 11/1965 | Bell et al. | 222/372 X |
| 3,265,251 | 8/1966 | Lense | 141/145 X |
| 3,821,873 | 7/1974 | Benner, Jr. et al. . | |
| 3,826,293 | 7/1974 | Cayton | 141/142 |
| 4,232,504 | 11/1980 | Dieterlen et al. . | |
| 4,344,269 | 8/1982 | Dieterlen et al. . | |
| 4,702,289 | 10/1987 | Benner, Jr. et al. | 141/125 |
| 4,848,421 | 7/1989 | Froese et al. | 141/114 |
| 5,060,450 | 10/1991 | Greenwell et al. . | |
| 5,082,032 | 1/1992 | Crocker | 141/144 X |
| 5,320,146 | 6/1994 | Stevie | 141/1 |
| 5,405,059 | 4/1995 | Wadell | 141/144 X |

*Primary Examiner*—J. Casimer Jacyna
*Attorney, Agent, or Firm*—Wood, Herron & Evans, PLL

[57] ABSTRACT

A rotary disc feeder includes a rotary plate with a plurality of radial slots and sliders disposed in the slots. The sliders are cam adjusted to define, respective volumetric chambers between their ends and the slot ends. The cams are carried on a rotational cam carrier positioned by an axially reciprocable but non-rotary positioner. The size of the volumetric chambers is adjusted on the fly. A hopper drops product into the chambers rotating thereunder. Product is dropped from the chambers through a slot in a shutter plate angularly spaced from the hopper. The chambers have a relatively extensive, open cross-section compared to chamber length and small doses of light density, static sensitive product is measured and dispensed rapidly.

24 Claims, 5 Drawing Sheets

ROTARY DISC FEEDER

BACKGROUND OF THE INVENTION

1. Field of the Invention

This invention relates to feeding material into packages or pouches and more particularly to apparatus and methods for measuring and dispensing one or more individual product components for feeding into pouches wherein at least one or more of the components is of relatively small volume.

2. Description of Prior Art

Packaging of powdered or particulate products into pouches for distribution, sale and consumer use has typically been accomplished, for example, by feeding a series of open-ended pouches around a filling wheel where the pouches are held open for filling. A plurality of spouts is mounted for rotation with the filling wheel and above the pouches. A metering apparatus is mounted above the rotating spouts for dropping product into the spouts and thence into pouches. The spouts rotate in a plane intersecting the plane of rotation of the filling wheel, such that spouts rotate down into the pouches in a filling area of the run of pouches about the filling wheel. Product is dropped through the spouts in this area and into the pouches. Multiple feeders have been used to feed relatively large quantities of different products into the pouches. Examples of apparatus for such prior filling operations are shown in U.S. Pats. Nos. 3,821,873; 4,232,504; 4,344,269; 4,702,289; 4,848,421; 5,060,450 and 5,320,146. Each of these is herewith incorporated by reference as if fully set forth herein.

Pouches are used to package products of various nature and use. For example, a homogeneous blend of components can be dispensed into a pouch for use where a portion of the product is used at one time while the remainder is used at a later time. This typically requires suitable component blending prior to pouch filling so that any portion of product removed is a homogeneous blend and any portion left over is also a homogeneous blend. In such applications, the product components are pre-blended and the total desired product weight accurately dispensed into the pouch.

Another pouch application is known as the "single-serve" package, where each pouch contains a product, all of which is used at the same time. In such a single purpose application, it is sometimes desirable to feed the individual components of the product mix into the pouch separately from the feeding process of other product components introduced into the pouch. Each component can thus be individually and accurately weighed and dispensed.

Lack of homogeneity in the product components in the single-serve pouch is of no factor since in a single serve application, the entire product fill is used at the same time. Such single service pouches may be found in the packaging of food mixes or pharmaceuticals, as well as in other applications.

In the instance where individual or combined components of a product are to be dispensed separately into a pouch singly or together with other components to make up a full product fill, the desired quantity of one or all of the separately fed components may be very small, and the accuracy of the amount by volume fed into the pouch is important. For example, in a pharmaceutical single serve dose, the active ingredient of a single pouch, or the small total dose, may comprise only a very small volume, and it is very important to accurately meter that small amount. Such small amounts are very hard to meter and dispense accurately and quickly on existing pouch filling apparatus for several reasons. This inability to accurately dispense very small quantities quickly limits the range of use of systems feeding separate components into pouches.

One of the reasons leading to difficulty in measuring and dispensing small product doses is the light density of a product. Another is that the prior dispensing units, such as those shown in the above-referenced patent disclosures, have inherent machine parameters which do not permit the accurate, fast dispensing of small volumes of product. For example, several of the patents disclose a series of volumetric metering cups mounted in a wheel beneath a scraper plate. Product is dropped onto the spinning plate and plows or brushes guide it over the volumetric measuring cups, filling them. See, for example, U.S. Pat. No. 4,848,421. While this works well in many applications, it is not suitable for measuring or dispensing small doses or portions of lightweight product components of less than one gram, for example, which translates into, for example, about one cc volume or even less. The manufacturing tolerances required for accurate, multiple piece cups of such small size would render the apparatus too inaccurate, even if useful cups of such small size could be made. The tolerances for very small volumes are so small that the two piece elongated cups do not repeatedly produce acceptable measure Another apparatus is shown in U.S. Pat. No. 5,320,146 wherein there are no "cups", per se, however, the metering wheel is provided with angled bores having inlet ports in the upper surface for receiving product and radial outlet ports for discharge. Product is scraped or plowed into the inlet ports and the bores which provide measured product quantities of a single product.

While the bore volume can be adjusted by various means such as sleeves, the bore length is difficult to shorten due to the geometry or configuration of the wheel. Thus, while the bore diameter can be reduced by sleeving, for example, such changes reduce the ratio of the cross-sectional area of the inlet port and/or bore to the overall chamber length. It is difficult to fill and discharge a relatively elongated, small cross section bore with a small volume of a lightweight product at desirable speeds of, for example, 500 bores filled per minute.

Another difficult problem to overcome arises from product which is susceptible to static electricity. Static electricity is generated by the relative motion of the brush or plow against the product on the metering wheel surface, or by the product rubbing against itself. Such static can turn the product particles or granules into what are, in effect, small magnets, adhering to each other and not flowing. This makes it difficult if not impossible to feed small doses or product since the product tends to agglomerate together, or on machine surfaces, rather than flow, even where the machine surfaces are electrically grounded.

Accordingly, it has been one object of the invention to provide improved apparatus and methods for accurately and repeatedly metering small volumetric amounts of product and for dispensing metered product into pouches.

In another aspect of the invention, it is also desirable to be able to adjust metered amounts of product precisely in order to produce accurate doses. Product density may vary with product lot or with weather, for example, and it is desirable to accommodate such changes by adjusting the metering chamber. Where, however, the metering chamber is very small to begin with, it is difficult and expensive to provide chamber volume adjustment.

Moreover, it is also desirable to be able to adjust the volumetric size of the metered dose on the fly, that is with the metering or feeding apparatus running. At the same time, it is desirable to eliminate relative motion between adjustment parts due to normal machine movement which would tend to wear the adjustment components of the feeder, and run them out of tolerance.

In the past, it has been known to use a rotating disc provided with fixed bores defining measuring chambers where the disc thickness defines the chamber length. The disc rotated under a hopper dropping seeds, for example, into the bores. The seeds were dropped from the bores on rotation of the disk. While such discs have been used on the order of about ¼ inch thick, and with bores about ¼ to ⅜ inch in diameter, for feeding seeds, for example, such measuring chambers were not adjustable in volume.

Thus, it has been a further objective to provide a small dose volumetric feeder having adjustable metering capacity and to provide a small dose volumetric feeder with an adjustable metering capacity operable on the fly.

SUMMARY OF THE INVENTION

To these ends, a preferred embodiment of the invention extends downward the volumetric range of product which can be fed accurately and quickly as compared to the prior volumetric cup or ring and belt feeders. Product volumes of less than about ½ cubic inch can be fed according to the invention at speeds up to and beyond 500 cycles or doses per minute.

The preferred embodiment includes a disc having a plurality of radially oriented slots extending through the disk. A reciprocal slider is disposed in each slot and a variable volumetric chamber is formed in the slot between the slot's outer end and the outer end of the slider. The disc is relatively thin such that the ratio of the cross sectional area of the volumetric chamber to the length of the chamber is more than about 1.23 to 1.0, and the front to back slot width in the machine direction is about twice the slot depth.

A hopper drops product onto the upper surface of the disc into the chambers. A "snake plate" or "shutter plate" having a crescent-shaped opening is located beneath the disk. When the filled chambers of the disc are rotated over the opening, the product drops from the chambers and through the opening for feeding into a pouch.

Each slider has an inward end comprising a cam follower. Depending cam fingers are engaged with the followers for moving the sliders in or out when the cam fingers are raised or lowered, respectively. The cam fingers are mounted on a cam plate or carrier which is yieldably urged upwardly against a wear plate on a cam positioner. The cam plate, cam fingers, sliders and discs are all driven to rotate, while the cam positioner and wear plate remains angularly stationary. The non-rotating positioner can be reciprocated to move the cam fingers up and down to thereby adjust the size of the volumetric chambers even while the disc is rotating.

The hopper for feeding product to the chambers in the disc rotating there beneath is provided with a bottom shoe of a wear-resistant material such as cast nylon, under which the disc slides. The shoe has an arcuate discharge slot substantially coextensive with a portion of the path traversed by the volumetric chambers in the disk. Product in the hopper and shoe falls into the advancing volumetric chambers in the disc as it rotates beneath the shoe. Product is not swept around by brushes or guides and thus does not rub together so as to generate sufficient static to cause the product particles to adhere to each other. The shoe extends beyond its discharge slot to confine product in the chamber, however, between the filling area and the drop or discharge area.

Accordingly, the invention provides a large chamber opening relative to length for volumetric chambers which are adjustable and provide for consistent, accurate, measurement and feeding of small amounts or doses of product at high packaging speeds. Lightweight, static-sensitive product is uniformly handled in small dose weights and the volumetric chambers are adjustable on the fly. There is no relative rotational motion between the adjustable sliders and the cam components, thus wear which may tend to reduce adjustment accuracy is eliminated.

The invention thus provides for the feeding of products or individual components at high speeds wherein the material being fed is less than about one half cubic inch in volume.

BRIEF DESCRIPTION OF THE DRAWINGS

These and other objects and advantages will be readily apparent from the following written description of the preferred embodiment of the invention, and from the drawings in which.

DETAILED DESCRIPTION OF PREFERRED EMBODIMENTS

Figure 1:
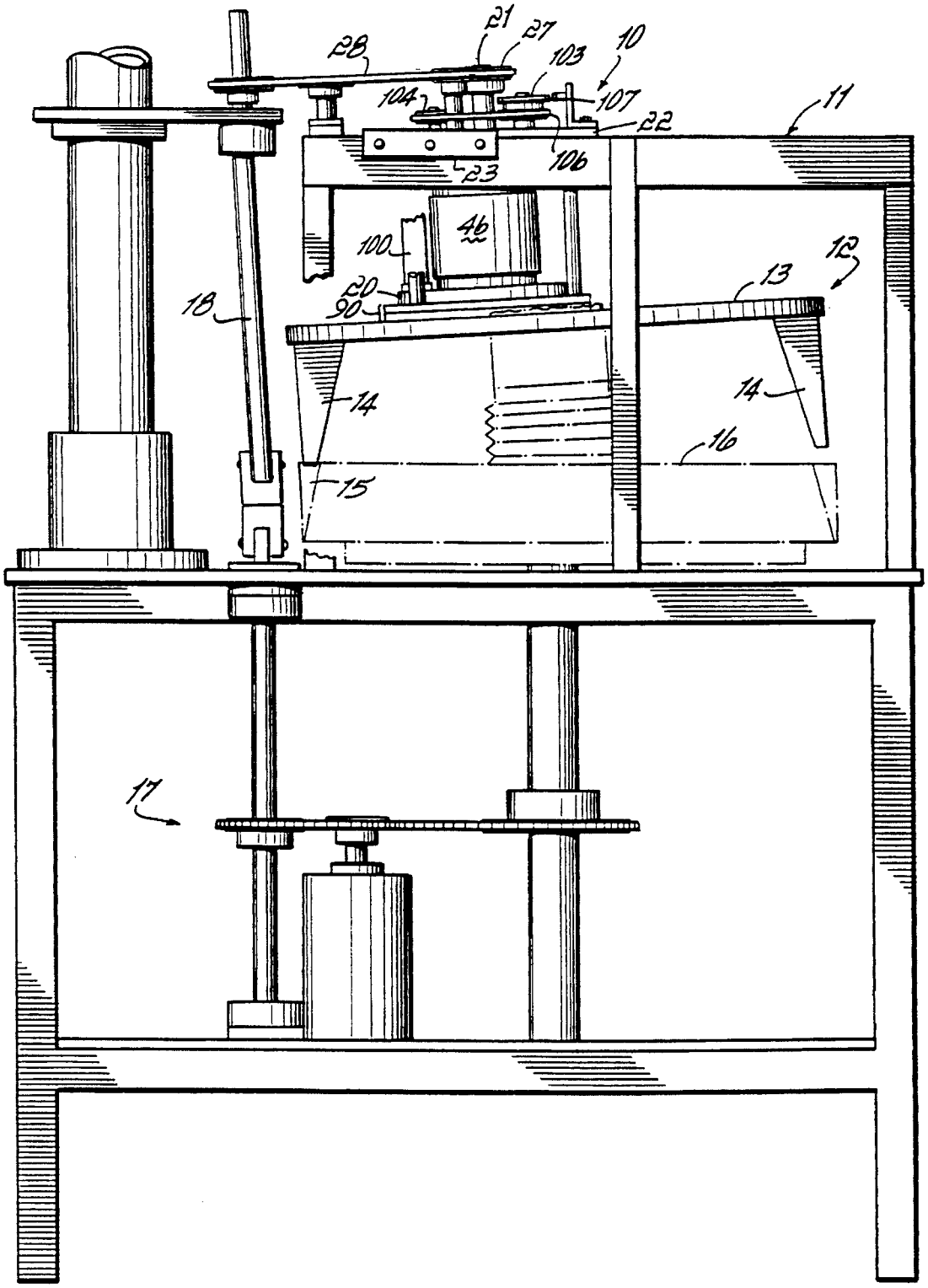
FIG. 1 is an elevational view illustrating the invention in use with a pouch filler and showing the filler and feeder drive.

Turning now to the drawings, there is shown in FIG. 1 an overall illustrative view of a rotary disc feeder according to the invention, as used with a pouch filler. In particular, a rotary disc feeder 10 is mounted on a frame 11, associated with a pouch filler 12. Pouch filler 12 is of the rotary filler wheel type, such as that illustrated in U.S. Pats. Nos. 5,320,146; 4,848,421; 4,702,289; 4,344,269; 4,232,504 or 3,821,873, or any other suitable pouch filler. Such prior patents are expressly herewith incorporated by reference, however, the structural details of the pouch filler itself do not comprise a part of this invention.

It will be appreciated that such pouch fillers generally include a tilted spout plate 13 having a plurality of depending spouts 14. The spout plate is mounted for rotation about an axis which is tilted away from the vertical, so that some of the spouts are sequentially rotated into the open tops of pouches 15 carried on a filler wheel 16 which is mounted for rotation about a vertical axis. The details of the spout plate and the pouch filler wheel are generally described in the foregoing patents and it is not necessary to describe them further here.

Such pouch filler 12 includes an appropriate frame 11, as noted, together with an appropriate drive 17 from which through a jack shaft 18, can be taken the drive for the rotary disc feeder 10 described herewith. The operation of the rotary disc feeder is thus synchronized with the pouch filler.

Figure 2:
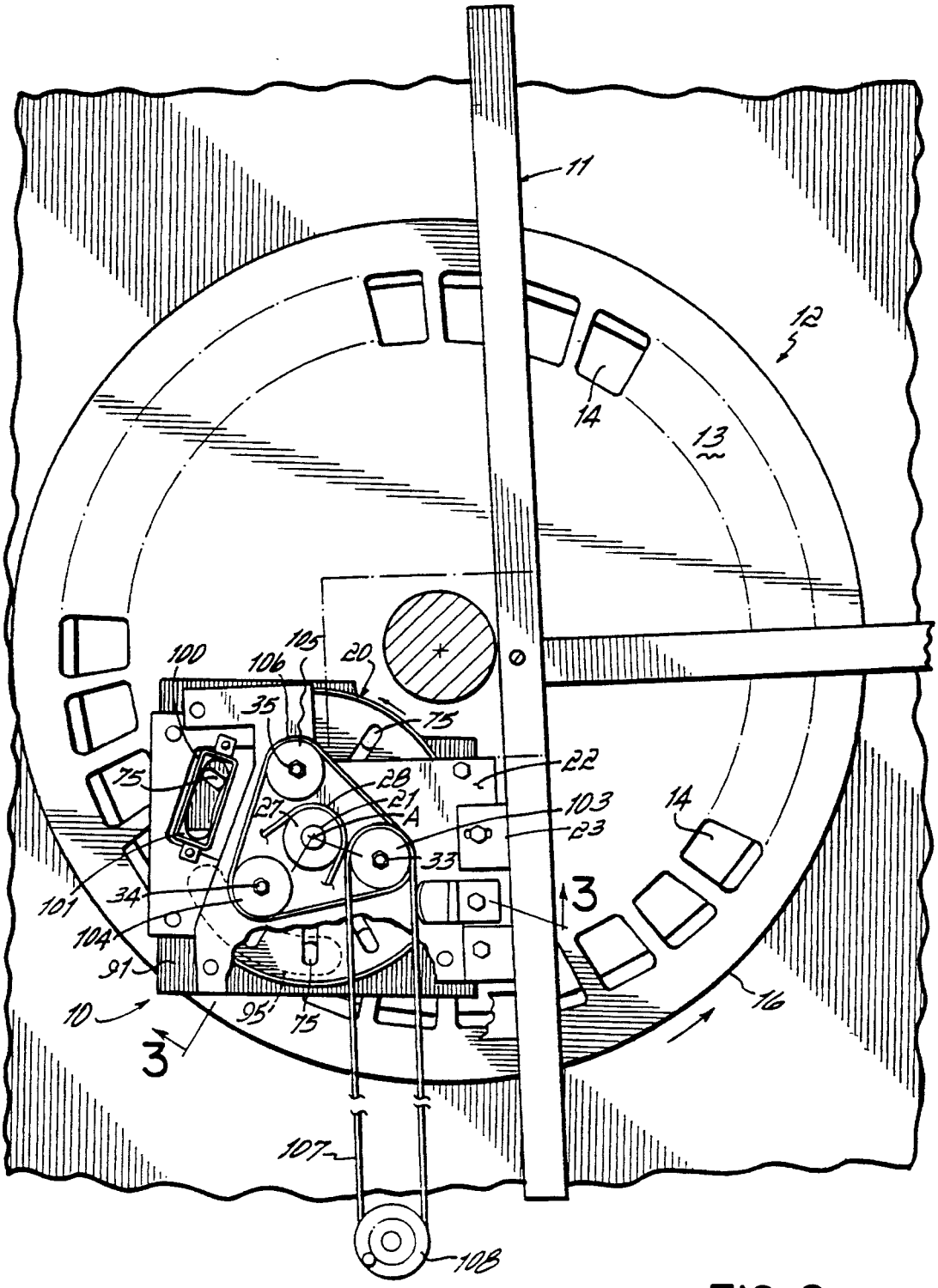
FIG. 2 is a plan view of the apparatus of FIG. 1 showing the cam adjust drive.

From FIG. 2, which is an overall plan view of the disc feeder and pouch filler as shown in FIG. 1, it will be appreciated that the disc feeder 10 is relatively small compared to the overall extension of the spout plate 13 and pouch filler wheel 16. Thus, it will be appreciated that one or a plurality of disc feeders 10 could be utilized in conjunction with a single pouch filler so as to provide for the introduction of one or a plurality of separate accurately measured product components into a single service pouch, such as pouch 15 (FIG. 1). In that manner, either one or a plurality of different product components, at least one of which is a relatively small volume, can be introduced into the pouches separately and independent from the feed of any other product components into the pouches.

Figure 3:
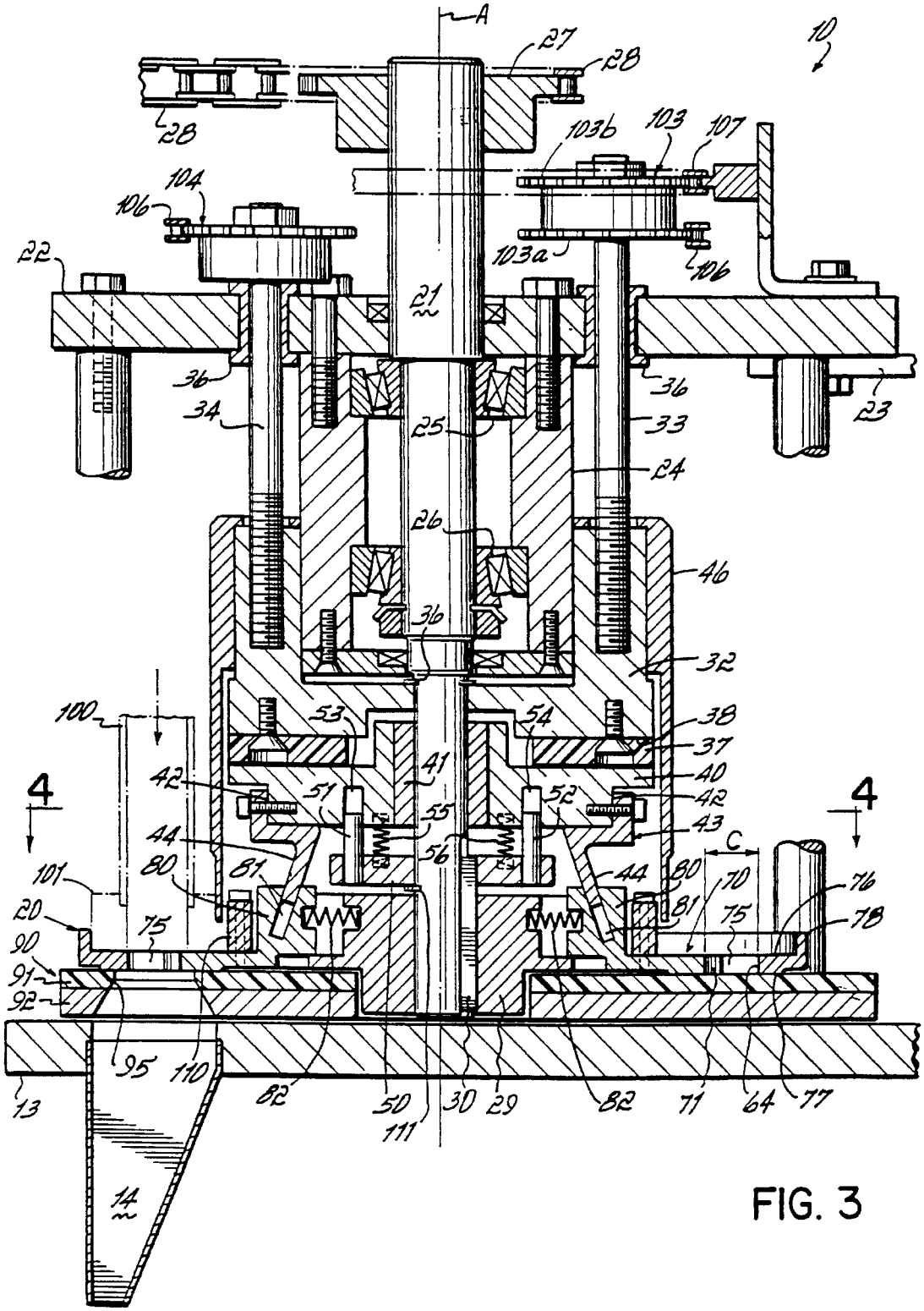
FIG. 3 is a cross-sectional view of the feeder of the invention taken along lines 3—3 of FIG. 2.
Figure 4:
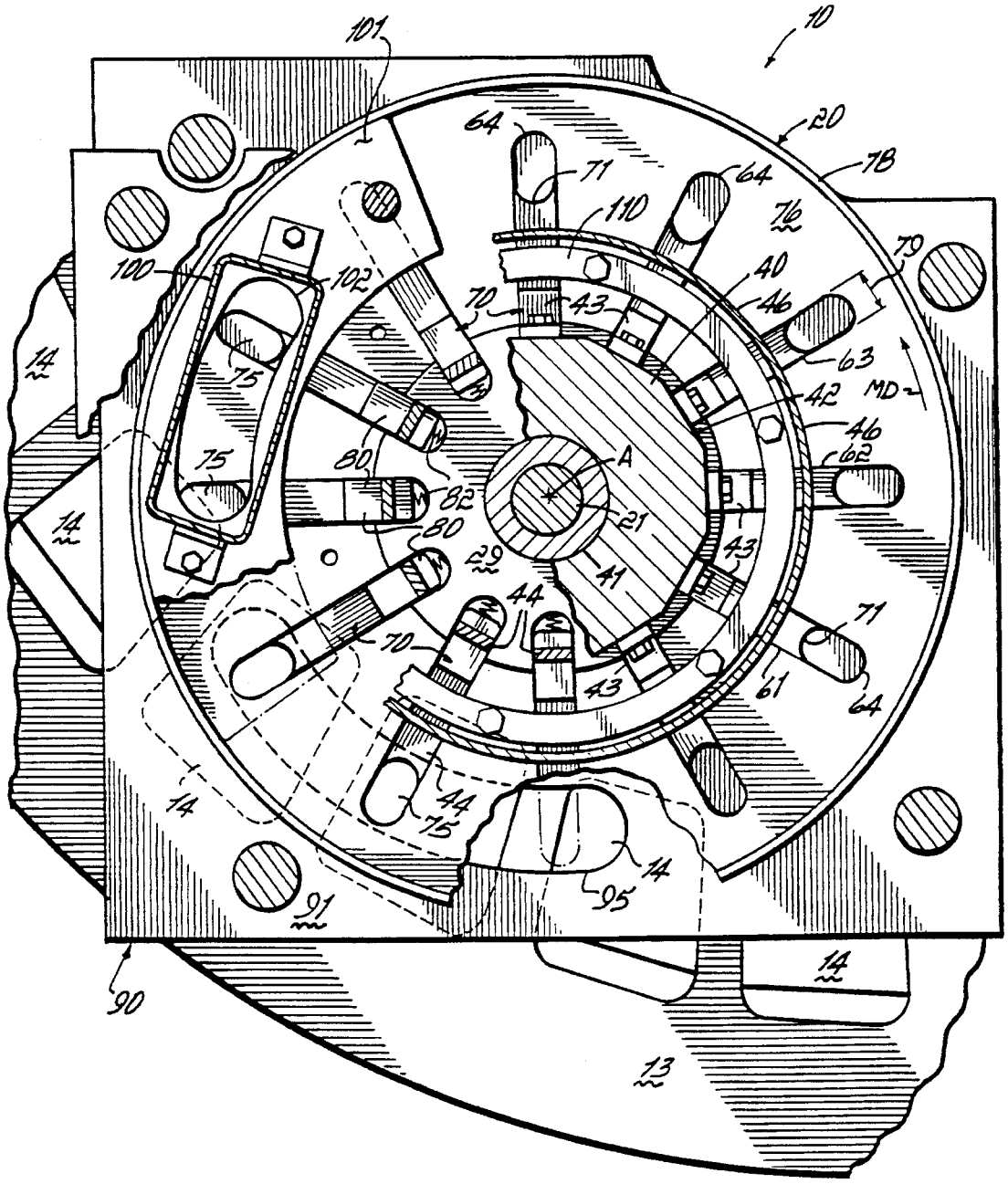
FIG. 4 is a cross-sectional view, partially broken away, taken along lines 4—4 of FIG. 3.
Figure 5:
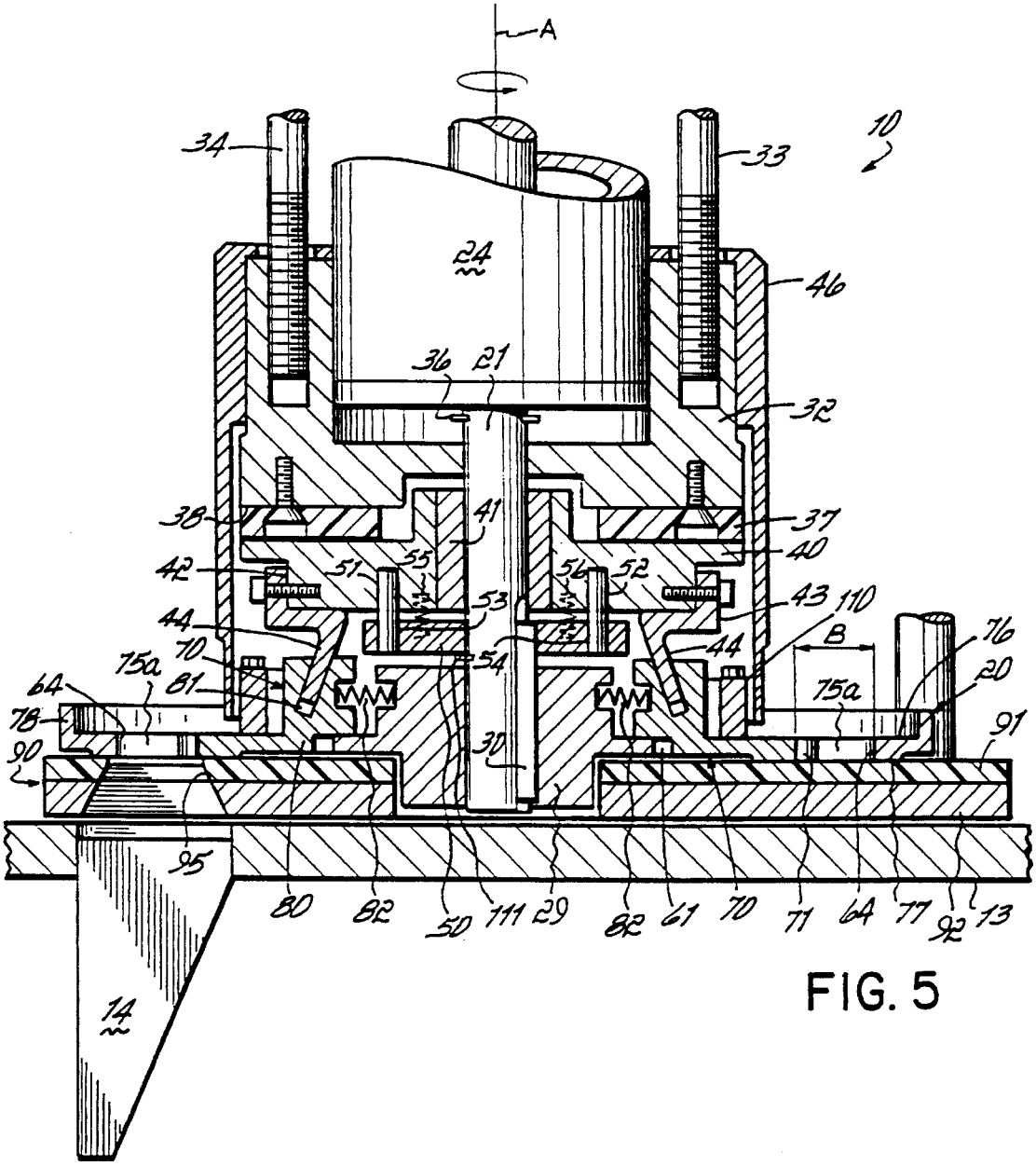
FIG. 5 is a cross-sectional view like FIG. 3, except showing the cam carrier in a lowered position to retract the sliders and increase the volume of the measuring chamber.

Turning now to FIGS. 3, 4 and 5, the various features of the rotary disc feeder 10 are shown in greater detail. The disc feeder 10 includes a rotary disc 20 (preferably about 9.5 inches in diameter although it could be larger or smaller) mounted on a drive shaft 21 which is journalled in a support plate 22 for rotation about axis A as shown in FIG. 3. Support plate 22 is mounted by any means, such as brackets 23, to the frame 11 of a pouch filler, for example. A shaft bearing sleeve 24 is bolted to the mounting plate 22 and includes bearings 25, 26 for mounting the shaft 21 rotationally with respect to the plate 22. The bearing sleeve is preferably made from a suitable material coated with a wear-resistant material such as teflon. A drive sprocket 27 is attached to the upper end of the shaft 21 and is operably connected by means of a chain 28 to a drive shaft 18 (FIG. 1) for driving shaft 21 via power takeoff from the pouch filling machine drive 17 (FIG. 1). Disc 20 includes a hub 29, preferably integral with disc 20, which is keyed to the shaft 21 by means of a key 30 for driving the disc about the axis A.

The feeder 10 also includes a cam positioner 32, preferably made of a suitable material having a wear-resistant coating such as teflon, and is supported by means of three screws 33, 34 and 35 to the plate 22 (FIG. 2). Screws 33, 34 and 35 are journalled in the plate 22 for rotation therein by means of sleeves 36. The screws are held against axial motion in plate 22. The lower ends of the screws 33–35 are threaded into the cam positioner 32, as shown in FIG. 3, so that when the screws are turned, the cam positioner can be moved in an axial direction along the axis A and with respect to the drive shaft 21. Shaft bearing sleeve 24 thus serves as an inner hub for the positioner 32, so that the positioner 32 can slide upwardly and downwardly along the sleeve 24. Upward motion of the cam positioner 32 is limited by a clip 36 on the shaft 21. It will be appreciated that the cam positioner 32 does not rotate, but is only movable in an axial direction along the shaft 21.

The cam positioner 32 includes a wear plate 37 bolted to the lower surface 38 of the cam positioner. It will be appreciated that the wear plate is in the form of an annulus and comprises a synthetic material, such as cast nylon or any other suitable material for resisting wear as the cam carrier described herein slides over it.

Also disposed about the drive shaft 21 is a cam carrier 40. Cam carrier 40 is mounted about shaft 21 by means of a sleeve 41 and the carrier 40 has a lower peripheral surface 42 to which are bolted a plurality of depending cam fingers 43. It will be appreciated that cam fingers 43 have lower ends 44, each of which comprises a flat cam finger disposed at an angle with respect to axis A, such that each cam finger is disposed along a line which intersects with axis A.

Below the cam carrier 40 is located a spring plate 50, which is also keyed by means of the key 30 to the drive shaft 21. Key 30 could be in two parts to avoid interference with clip 111, if necessary. A plurality of pins such as pins 51 and 52 extend downwardly from the cam carrier 40. While two pins are shown, a third pin could be used with the pins equidistant angularly about axis A. Preferably, one pin might be used to reduce alignment problems. The pins 51, 52, or one pin or others, as the case may be, are pressed in respective bores, in spring plate 50. The pins are slidably received in bores 53, 54 in carrier 40, so that as the cam carrier 40 moves in an axial direction along the drive shaft 21, the pins 51, 52 slide in the respective bores 53, 54 in the carrier 40. Springs 55, 56, as well as a third spring (not shown) and/or others are disposed symmetrically between the cam carrier 40 and the spring plate 50, so as to urge those two elements apart.

Returning to FIG. 4, it will be appreciated that the disc 20 is provided with a plurality of radially disposed slots, such as the slots 61, 62 and 63 and the others shown in FIG. 4. Each of the slots as shown in FIG. 4, for example, are similar, in that they are each radially extended from axis A at about 30° angular separation and preferably include a rounded outer end, such as shown at 64 in FIG. 4.

Disposed within each of the slots is an adjustable slider finger 70. Slider finger 70 includes a concave radially outward end 71 so that the rounded end 64 of each slot and the concave end 71 of each finger defines, together with the remaining portions of the respective slot, a volumetric measuring cavity such as that cavity 75 as shown in FIGS. 3 and 4. Each of the radial slots, together with their respective fingers, thus define a plurality of volumetric chambers 75 disposed in and through the disc 20 and oriented radially about the axis A.

It will be appreciated that each of the slots, such as slot 61, 62, 63 and the others, extend entirely through the disc from an upper surface 76 thereof, to a lower surface 77 thereof, such that the slots extend all the way through the relatively thin disk, and such that the length of the volumetric chamber is defined by the width or thickness of the disk.

Since the disc 20 is relatively thin, the ratio of the cross-sectional area of the chambers 75 in the chamber length or depth is about 1.23 to 1. More particularly, and recognizing an opening of given area may have multiple shapes, it is preferred to provide a large open fill opening to the volumetric chamber so it can be quickly loaded and discharged. Accordingly, the cross dimension of the chamber opening from front to back measured along the chamber's direction of motion "MD" (FIG. 4) as the disc turns is preferably about twice the length (depth) of the chamber. This cross dimension is illustrated by the arrow 79 in FIG. 4. The length or depth of the chamber is defined by the thickness of disc 20. It is contemplated that various shaped openings other than elliptical may be used generally within these parameters.

As shown in FIGS. 3 and 4, the disc also includes an upstanding skirt 78, useful for catching any product inadvertently on the disc at its peripheral edge.

Each of the sliders 70 has, at its radial inner end, a cam follower 80, each of which has a slot 81 therein oriented at an angle with respect to axis A. The angle of inclination of slots 81 is substantially equal to the angle of inclination of the lower ends 44 of the cam fingers 43. The lower end 44 of a cam finger 43 fits within each of the slots 81. A spring 82 is disposed between the hub 29 and the cam follower 80 for constantly biasing the adjustable sliders radially outward toward the outer end 64 of the respective slots.

A stationary shutter plate 90 is disposed beneath the disc 20 and is comprised of an upper wear resistant surface 91 and a lower support plate 92. The shutter plate 90 includes an arcuate or crescent shaped slot 95 disposed therein, along a circular path which is traversed by the chambers 75 as those chambers rotate about the axis A when the disc 20 is rotated. Thus, any material within the chamber 75 is dropped from that chamber when the chamber rotates over the elongated arcuate shaped slot 95.

In this regard and with particular reference to FIG. 3, it will be appreciated that there is also provided a hopper 100, having a lower end or in the form of an arcuately shaped shoe 101, made of a wear resistant material such as, for example, cast nylon. A hopper discharge slot 102 is arcuately shaped and preferably extends over the path of the chambers 75 rotating therebeneath. The slot 102 is preferably as wide as the maximum design opening or chambers 75 (75*a*) so product falls efficiently to fill the chambers. As shown in FIG. 3, the lower end or shoe 101 is disposed in sliding relationship with the upper surface 76 of the disc 20. However, it will be appreciated from a review of FIG. 2, that the hopper 100 as shown diagrammatically in FIG. 3 has been slightly reoriented in FIGS. 3 & 4 for clarity. The actual orientation of the hopper 100 is as shown in FIG. 2 & 4, where it can be seen that the hopper 100 is angularly offset from the crescent shaped discharge slot 95 in the shutter plate 90. Accordingly, it will be appreciated that product in hopper 100 is dropped through slot 102 into the chambers 75 as those chambers rotate with the disc beneath the hopper 100. The product so discharged into the chambers 75 is not immediately dropped through the shutter plate 90. That does not occur until the chamber 75 filled with product rotates over the arcuate shaped opening 95 in the shutter plate 90.

More particularly, it will be appreciated (FIG. 4) that slot 102 terminates in the machine direction MD prior to termination of shoe 101 in that direction. Shoe 101 extends in the machine direction over the upstream end of discharge slot 95. The lower closed surface of shoe 101 thus confines product in the chambers 75 from backing out as the chambers move from the fill area defined by slot 102 to the discharge area defined by slot 95. Also, it will be appreciated this distance is maintained very short so that any relative motion of any feeder component and product is minimized to prevent undesirable static buildup. The total angular distance between the downstream end of slot 102 and the upstream end of slot 95 is less than 30°, and about 3 or 4 inches from axis A.

Returning now to FIG. 3, each of the screws 33, 34 and 35 are provided with sprockets for adjusting the screws and thus the axial disposition of the cam positioner 32 along the drive shaft 21. Screw 33 is provided with a double sprocket 103, while screws 34 and 35 are provided with sprockets 104 and 105. Sprocket 103 is a double sprocket and has a lower set of teeth in alignment with the teeth on sprockets 104 and 105, such that a chain 106 can be wrapped around these portions of the sprockets so that they all rotate simultaneously. Double sprocket 103 has an upper round of teeth 103*b* which are engaged by a chain 107 interconnected to a handwheel 108 (FIG. 2). Thus, when handwheel 108 is manually rotated, that motion is imparted by chain 107 to the double sprocket 103 and, in turn, the sprockets 103, 104 and 105 simultaneously drive the screws 33, 34 and 35 for raising and lowering the cam positioner 32 in an axial direction along the axis A.

It will also be appreciated that the rotary feeder 10 also includes a hold down ring 110 which is secured to the plate 20 by means of the bolts as shown in FIGS. 3, 4 and in FIG. 5. This hold down ring is disposed on the upper surface 76 of the disc 20, so that the adjustable sliders 70 can slide in a radial direction thereunder, with the ring 110 holding the sliders 70 down in operative position within the slots in which they are disposed.

Reference is now made to FIG. 5, wherein the feeder 10 is illustrated in a different orientation than in FIG. 3, the sliders 70, having been retracted as will be explained, to define a larger volumetric measuring chamber 75*a* than as shown in FIG. 3. With reference to FIG. 5, it will be seen that the screws 33 and 34 have been rotated in a direction so as to move the cam positioner 32 downwardly. This is exhibited by the space which is now shown in FIG. 5 beneath the respective screws 33 and 34 in the cam positioner 32. Comparing this area of the figure with respect to FIG. 3, it will be seen in FIG. 3 that the screws 33, 34 are bottomed out in the positioner. Since the screws are journalled in plate 22 against vertical motion, any rotation of the screws within the plate 22 causes the cam positioner 32 to move on the screws' threads in an axial direction along axis A, which is substantially vertical, although perhaps slightly inclined, as suggested in FIG. 1. Accordingly, FIG. 5 shows the cam positioner 32 moved downwardly along the axis A and toward the disc 20, thus compressing the springs 55, 56. This spring compression is a result of the positive clip 111 serving to prevent downward motion of the spring plate 50 along the drive shaft 21. Thus the springs 55, 56 constantly urge the cam carrier 40 in an upward direction toward positioner 32 and against the wear plate 37. As the cam positioner 32 and its wear plate 37 move downwardly, however, it will be appreciated that the cam carrier 40 is moved downwardly, and that the lower ends 44 of the cam fingers 43 are moved further into the slots 81 of the adjustable sliders 70. This motion, as will be appreciated, moves the adjustable sliders in a radial inward direction, thereby moving the concave ends 71 of the sliders inwardly away from the concave ends 64 of the slots in which they reside. This results in a wider, bigger volume chamber, as indicated by the respective arrows B in FIG. 5 (chamber 75*a*) and C in FIG. 3 (chamber 75). Since the cam followers are moved radially inwardly, the width of chamber 75*a* in FIG. 5 represented by the arrow B is greater than the width C of the chamber 75 in FIG. 3. Thus, as shown in FIG. 5, the chamber 75*a* has a greater cross-section and volume than the chamber 75 illustrated in FIG. 3. It will also be appreciated that the radial width of the chamber, which equates to its cross-sectional area, is also greater than that of the chamber 75 in FIG. 3. Thus, as the chamber is enlarged, it will be appreciated that the cross-sectional area of the chamber is also enlarged, while the length or depth of the chamber, which is represented by the thickness of the disc 20 in which the slots are located, remains the same. Thus, while the chamber length remains the same, the cross-sectional area and volume of the chamber can be varied, maintaining a relationship conducive to accurate, repeated chamber fill and discharge cycles.

As noted above, the chamber opening in the machine direction is maintained at a dimension noted at 79 in FIG. 4. This dimension is defined by the slots in the machine direction and is preferably about twice the chamber depth as defined by the thickness of disc 20. This insures that the chamber opening is sufficiently wide to readily accept small product volume at high speed.

Springs 82 constantly bias the adjustable sliders in a radially outward direction, thus taking out any backlash in wear or tolerance between the lower ends 44 of the cam fingers 43 and the slots 81 and the cam followers 80.

When it is desired to provide a smaller volumetric measuring chamber 75, the cam positioner 32 is moved upwardly by relative rotation of the screws 33, 34 and 35.

This permits the springs 82 to bias the adjustable sliders in an outward radial direction. If there is resistance to this motion by some product remaining in the slot or some other interference for example, then the continued upward motion of the radially outward surface of the lower cam fingers 44 will positively move the slider 70 in a radially outward direction.

Returning now to FIG. 4, it will be appreciated that as the respective chambers 75 rotate about axis A under the hopper 100, the product moves under the crescent-shaped slot 102 in hopper foot or shoe 101 and is dropped into the chambers rotating therebeneath. Thereafter, the plate 20 continues to rotate, moving the chambers out from under the slot 102, at which time the shoe 101 simply cuts off product above the chamber 75. Thereafter, the chamber 75 moves toward and over the arcuate discharge slot 95 in the lower shutter plate with the shoe 101 confining the product, but only for the relatively short travel to slot 95. At the same time, a spout 14 is moved to the upstream end of the arcuate slot 95. The speed of chamber 75 is coordinated with the angular speed of spout 14 and the length of slot 95 such that a sufficient time duration exists for product in the chamber 75 to be dropped into the spout 14 for disposal or dispensing into a pouch (not shown) as the chambers and spouts move in coincidence or register. Thereafter, as illustrated in FIG. 4, the spouts continue in their circular path, which has a diameter much greater than the diameter of the circular path in which the chambers 75 move, and the chambers are shut off by shutter plate 90 and are again rotated around for refilling at the hopper 100.

It will thus be appreciated that as the drive shaft 21 rotates, it carries with it the disc 20, the spring plate 50 and the cam carrier 40. Due to the bias of the springs 55, 56 between spring plate 50 and the cam carrier 40, the cam carrier 40 is urged axially along the axis A into engagement with the wear plate 37 on the cam positioner. It will also be appreciated that the cam positioner 32 does not rotate, but only moves axially along the outer diameter of sleeve 24 and axis A. The cam positioner 32, of course, is maintained against rotation by means of its interconnection to the screws 33, 34 and 35.

The entire mechanism can be covered by a cover or housing 46, as shown in FIG. 3, which extends down over the hold down ring 110, and rises and descends with the cam carrier, and does not rotate. Thus, the rotating elements, except for the outer edges of the disc 20 and its upper surface 76 are covered by the housing 46. Accordingly, as the drive shaft 21 rotates, the cam carrier 40 follows the cam positioner 32 and particularly the lower surface of the wear plate 37. As the cam positioner is moved downwardly such as illustrated in FIG. 5, the cam fingers are moved downwardly, drawing the adjustable sliders inwardly and opening the volumetric measuring chambers 75*a* (FIG. 5) in the disc 20. As the cam positioner is moved upwardly, such as to the position as shown in FIG. 3, the pressure of the springs 55 and 56 urge the cam carrier 40 upwardly and the relative sliding motion between the fingers 44 and the slots 81 and the follower 80 causes the sliders to move outwardly, thus decreasing the volume of the measuring chamber 75 (FIG. 3). It will be appreciated that there is no rotary or sliding motion between the cam fingers 44 and the cam followers 80, except as generated by the linear movement of the cam positioner 32. All the relative rotary motion during ordinary rotation of the disc is taken up by the wear plate 37 against the cam carrier 40. Thus, there are no volumetric chamber measuring tolerances which are worn out or changed by the ordinary rotary motion of the disc feeder.

As noted before, any backlash in the slider and adjustable cam apparatus is taken up by the springs 82 and the apparatus is operable to more accurately return to a preset or predetermined position by means of the adjustable handwheel 108. Moreover, it will be appreciated that adjustment of the volume of the measuring chamber 75 can be performed during actual rotation and use of the disc feeder. Thus the chambers can be adjusted without any down time and even while the disc feeder is in operation.

It will also be appreciated that while a handheld wheel is shown for adjusting the chamber size, the adjustment could be made by means of an electronically controlled drive for the adjuster sprockets 103, 104 and 105, so that any particular chamber size could be programmed into an electronic controller and the chamber volume could be electronically controlled to assume a predetermined chamber volume or as a function of product density, ambient humidity or the like as desired.

As illustrated in FIGS. 2 and 4, it will also be appreciated that the rotary disc feeder 10 can be used either by itself to feed a single product into spouts for disposition into pouches, for example, or a plurality of feeders 10 could be utilized in conjunction with the same spout wheel 13 in order to feed a plurality of individual components into pouches. The feeders could thus be disposed internally of the circumference of the spout wheel or substantially externally thereof, and thereabout in appropriate positions for measuring and dispensing product into the spouts 14 for introduction into pouches.

It will also be appreciated that the volumetric chambers 75 are defined, in part, lengthwise by the thickness of the disc 20 and in cross-sectional area by the relative disposition of the ends of the radial slots and the ends of the respective adjustable sliders. This produces a measuring chamber having a large cross-sectional area as opposed to the length of the chamber, which has been found to be particularly suitable for low volume products and particularly static sensitive low volume products. In short, products of very small amounts or weights can be accurately measured at high speeds with such a chamber. It has also been found that, if necessary, a load buffer could be utilized in the hopper 100 so that the actual head pressure on the product as it is fed into the chambers from the hopper is maintained at a relative, constant value.

It will also be appreciated that as the chambers rotate under the hopper in the shoe 101, they simply fill up with product dropped therein and thereafter rotate out from under the shoe, with the shoe 101 cutting off any overage along the top surface 76 of the disc 20. Accordingly, the product is not significantly rubbed or moved against itself, nor against a machine element for too long duration and the creation of deleterious static electricity within the product particles is eliminated or so substantially reduced as to eliminate the problem inherent in prior feeders where the product is swept or directed by elongated guides across the top surface of a volumetric cup wheel.

In one embodiment of the invention, the chambers 75 are adjustable in volume from about 0.06 cubic inches to about 0.072 cubic inches. In this configuration, one pharmaceutical product could be fed in the weight adjustable range of about 720 milligrams to about 870 milligrams, and at a rate of up to 500 cycles per minute or greater. Of course, the weight of product measured and dropped depends on the density of the product. The ability to make very small volume changes in chamber size, however, can accommodate product density changes generated by humidity, moisture content, lot variations and the like, as well as by varied design doses.

Also, it will be appreciated that while the invention can accurately handle at speed small volume doses well below 0.5 cubic inches, it could handle doses above 0.5 cubic inches where necessary.

Accordingly, it has been discovered that a rotary disc feeder, according to the invention, is serviceable for adjustably handling individual products in the volume range of less than ½ cubic inch and at speeds of up to 500 cycles per minute (i.e. 500 dropped doses from the feeder per minute or greater). It has also been discovered that it is possible, using the invention described herein, to produce a plurality of individual components for disposal into a single service pouch wherein at least one or more of the components bears a very small percentage by volume of the final pouch fill. This is particularly useful in such single service pouch applications as in, for example, the pharmaceutical or food field, where it is critical to accurately measure a single active ingredient, for example, which makes up only a very small portion of the volume of the entire pouch fill or is in itself a small volume single dose. Thus, an active pharmaceutical ingredient, for example, can be accurately dispensed into a single service pouch wherein by and large the remainder of the pouch product fill, if there is one, constitutes a larger volume portion of the entire pouch contents, while the active ingredient constitutes only about 10% or less of the volume thereof, for example. Prior dispensers or feeders discussed earlier are not suitable for the fast and accurate measuring and dispensing of such small and adjustable doses, and are either too expensive, too inaccurate or both. Thus, it is clear that the combination of the parameters of the invention described, including the high operating speeds, the low dose volumes of product components pre-measured and dispensed, coupled with the static sensitivity of the product and with the relatively short length but wide cross-sectional volumetric measuring cavities which are adjustable, even during operation, produce and move downwardly the range of products and product volumes which can be efficiently and commercially handled in a pouch filling operation.

It should also be appreciated that while the feeder disclosed herein is particularly useful in filling pouches, the feeder can be used to measure and dispense small dose products into other packages or containers, or for other applications.

These and other modifications and advantages will become readily apparent to those of ordinary skill in the art without departing from the scope of this invention and the applicants intend to be bound only by the claims appended hereto:

What is claimed is:

1. Product feeding apparatus comprising:

a rotary disk mounted for rotation about a vertical axis;

at least one radially disposed slot extending through said disk;

at least one adjustment slider which is radially movable with respect to said axis and is operably disposed in said slot and defining with said slot a volumetric, product receiving and measuring chamber movable along a circular path as said disc rotates; and a cam for adjusting the radial extension of said slider in said slot for adjusting the volume of said chamber.

2. Apparatus as in claim 1 wherein said cam is mounted on a reciprocal cam carrier for relative motion with respect to said slider.

3. Apparatus as in claim 2 including a reciprocable cam positioner, and a spring for urging said cam carrier against said positioner for relative motion with respect to said slider when said positioner is moved.

4. Apparatus as in claim 3 further including at least one positioner moving screw for reciprocating said positioner with respect to said disc and moving said slider when said screw is rotated.

5. Apparatus as in claim 4 wherein said disc is driven about an axis and wherein said screw is parallel to and offset from said axis.

6. Apparatus as in claim 3 wherein said disk, slider, cam and cam carrier are all rotationally driven about an axis and wherein said positioner is fixed against rotation about said axis and is reciprocable along said axis.

7. Apparatus as in claim 6 wherein said positioner includes a wear plate disposed between said positioner and said carrier.

8. Apparatus as in claim 7 further including:

a disc drive shaft extending along said axis;

a disc hub connecting said shaft to said disk;

a spring plate interposed between said cam carrier and said hub, said spring plate connected to said drive shaft;

at least one pin extending between said cam carrier and said spring plate for rotating said cam carrier with said spring plate;

said spring plate being fixed on said shaft against axial movement therealong; and at least one spring operably disposed between said spring plate and said cam carrier for biasing said cam carrier against said wear plate, such that said cam carrier follows reciprocal motion of said positioner.

9. Apparatus as in claim 8 wherein said spring, spring plate and pin rotate with said disc and said cam carrier about said axis.

10. Apparatus as in claim 9 wherein relative motion between said cam and said cam follower is linear, and wherein relative motion between said cam carrier and said cam positioner is rotary.

11. Apparatus as in claim 6 including a cam follower on said slider operatively inter-engaged with said cam.

12. Apparatus as in claim 11 wherein said cam follower comprises a cam receiving slot disposed at an angle intersecting said axis.

13. Apparatus as in claim 12 wherein said cam comprises a finger depending from said cam carrier at said angle whereby reciprocation of said carrier along said axis moves said slider radially with respect to said axis.

14. Apparatus as in claim 13 including a spring for biasing said slider radially away from said axis.

15. Apparatus as in claim 1 further including a hopper having a lower end disposed in sliding engagement over an upper surface of said disk.

16. Apparatus as in claim 15 wherein said lower hopper end is elongated in a direction at least partially co-extensive with said circular path transcribed by said measuring chamber.

17. Apparatus as in claim 1 including a shutter plate underlying said disc and having an arcuate slot therein disposed under said circular path for passing product from said chamber moving over said slot.

18. Apparatus as in claim 1 wherein said disc is from about 0.1" to about one inches in thickness.

19. Product feeding apparatus comprising:

a rotary disc having an upper surface rotatable about a vertical axis;

a plurality of radially disposed volumetric chambers extending through said disc and movable through a path about said axis;

a chamber volume adjustment slider which is radially movable with respect to said axis and which is mounted in each of said chambers, for adjusting the size of said chambers within said disc;

a hopper having a lower end shoe disposed in sliding engagement with said upper surface of said disc;

a fill slot in said hopper shoe extending along and above a portion of said path for filling said chambers with product rotating thereunder;

a shutter plate under said disc and defining a discharge slot underlying another portion of said path;

the angular separation of said fill slot and said discharge slot measured along said path being less than 20°.

20. Apparatus as in claim 19 wherein said shoe extends from said fill slot over said chamber and said discharge slot for confining product in said chambers prior to discharge.

21. Product feeding apparatus comprising:

a substantially horizontally disposed rotary disc having an upper surface;

a plurality of radially disposed volumetric chambers extending through said disc for rotation along a circular path wherein the thickness of said disc defines the vertical length of said chambers;

said chambers having an adjustable volume and a front to back opening in said disc at least about twice as long as said disc is thick.

22. Apparatus as in claim 21 further including at least one adjustment slider operably disposed in each chamber and defining respective adjustable volumetric product receiving and measuring chambers movable along a circular path as said disc rotates about an axis.

23. Apparatus as in claim 22 including a cam for adjusting the radial extension of each said slider about said axis for adjusting the volume of each said chamber.

24. Product feeding apparatus comprising:

a rotary disk having a circular periphery two sides and being mounted for rotation about an axis;

at least one radially disposed slot extending through said disk from one side thereof to the other;

at least one adjustment slider which is radially movable with respect to said axis and is operably disposed in said slot and defining with said slot a volumetric, product receiving and measuring chamber movable along a circular path as said disc rotates; and a cam for adjusting the radial extension of said slider in said slot for adjusting the volume of said chamber.

* * * * *